United States Patent [19]

Szostak et al.

[11] 3,986,468

[45] Oct. 19, 1976

[54] SEWING MACHINE NEEDLE

[75] Inventors: Henryk Anthony Szostak, Oak Park; William Roy Parker, Mount Prospect, both of Ill.

[73] Assignee: Union Special Corporation, Chicago, Ill.

[22] Filed: Nov. 17, 1975

[21] Appl. No.: 632,533

[52] U.S. Cl. ..... 112/222

[51] Int. Cl.[2] ..... D05B 85/00

[58] Field of Search ..... 112/222, 223, 224; 223/102

[56] References Cited

UNITED STATES PATENTS

| | | | |
|---|---|---|---|
| 1,949,349 | 2/1934 | Brown | 112/222 |
| 3,347,192 | 10/1967 | Lukins | 112/222 |

FOREIGN PATENTS OR APPLICATIONS

| | | | |
|---|---|---|---|
| 1,433,041 | 2/1966 | France | 112/222 |
| 1,143,980 | 4/1957 | France | 112/222 |
| 1,193,006 | 5/1965 | Germany | 112/222 |
| 734,656 | 8/1955 | United Kingdom | 112/222 |

*Primary Examiner*—George H. Krizmanich
*Attorney, Agent, or Firm*—John A. Schaerli; John W. Harbst

[57] ABSTRACT

An improved sewing machine needle provided with tapered flat surfaces on both sides of the needle, beginning at a point slightly rearward of the needle's eye and converging towards the point of the needle.

3 Claims, 5 Drawing Figures

SEWING MACHINE NEEDLE

BACKGROUND OF THE INVENTION

This invention relates to sewing machine needles, and more particularly to sewing machine needles which have flats on both sides of the needle in the area of the needle eye. These flats taper down towards the needle point.

The needles that have been heretofore available for use in straight needle industrial sewing machines, and particularly for Class 39800 overedge sewing machines, manufactured by Union Special Corporation, suffer from certain drawbacks. The manner in which the needles are formed is one of these drawbacks. Such overedge sewing machine needles are provided with longitudinally extending grooves, either on the front or backside of the needle, or on both sides, and serve to protect the thread as it passes through the fabric. Heretofore these grooves have been produced on the needle by using a milling cutter thereby physically removing the metal.

It was likewise the practice to produce the needle eye in a similar manner. Most needle manufacturers have since changed the method of producing the eyes and grooves upon the needle. Rather than milling the thread groove and needle eye into the sewing machine needle they are now produced by striking the needle with dies. Eyes and grooves manufactured by such a process are usually termed either "struck" or "die press" groove and eye needles or some close variation of these terms. By utilizing this stamping process the metal is compressed causing it to relocate and form the needle. This method also adds strength to the needle.

The stamping of the needle eye does prove to have its disadvantage in that it can result in certain imbalances, particularly in the needle eye area. Such imbalances during high speed operation of the sewing machine can result in the needle either vibrating or fluttering. This erratic movement of the needle can cause the point, for example, to strike the machine throat plate, the top of the looper, or the needle guards, thereby causing needle breakage resulting in costly downtime. The degree of uncertainty caused by this stamping process and by the displacement or relocation of the metal forming the needle also creates a certain amount of uncertainty with regard to the proper stitch formation. That is, in order to produce good stitch formation it is desirable that the looper and spreader get as close to the needle as possible thereby lessening the chances of skipped stitches. Skipped stitches are caused, for example, with synthetic thread because it clings to the fabric and the needle rather than forming a loop which is grasped by either the looper or the spreader. As is apparent, if an uncertainty exists as to the shape of the needle it may be necessary to make adjustments on the looper and spreader for each and every needle change, a situation which is very undesirable and costly. Another drawback with having the grooves and needle eyes stamped on the needle is the fact that the top edges of certain elements subsequent to stamping may be very sharp. This would cause both fabric cutting and increases the possibility of operator injury.

Another problem associated generally with needles which are employed with sewing machines is that of needle heat. That is, as the needle passes into and out of the fabric workpiece, frictional heat is generated. In order to overcome this difficulty, it has been suggested that a ball eye needle be employed in certain particular sewing functions. One of the main advantages in using a ball eye needle is that the needle eye is larger at the needle eye area than the blade portion above it, thereby mitigating the heat built up on the blade portion by reducing its contact with the fabric.

In view of the foregoing, the present invention has for an object to provide a needle having stamped grooves and a stamped needle eye which is substantially uniform in the area of the needle eye.

It is another object of this invention to provide a needle having both stamped grooves and a stamped eye but yet does not leave the top edges of the flat surface provided thereon sharp.

Yet another object of this invention is to provide a stamped ball eye needle having two stamped grooves and provided with flats in the area of the ball eye thereby decreasing the size thereof and decreasing the amount of needle heat produced during the sewing operation.

Still another object of this invention is to provide a stamped sewing machine needle which is thereafter so modified as to allow a closer approach of the looper and the spreader to the needle thereby assuring better stitch formation.

Yet another object of this invention is to provide a stamped sewing machine needle having flats thereon which allows for greater amount of clearance between the looper or spreader when large diameter needles are utilized thereby lessening needle breakage.

According to the invention, the improved needle comprises a leading end portion of generally conical shape, an eye portion, a shank portion which is at the butt or trailing end of the needle, and a blade portion intermediate the butt portion and the eye portion. In the preferred embodiment, the blade portion has grooves along the top and bottom side thereof. These grooves as well as the needle eye are stamped or struck with a die as described above. On the groove sides of the needle, beginning at an area adjacent the blade portion and extending toward the conically shaped end portion, are tapered flats. These tapered flats are created by the physical removal of material and slope or taper downwardly toward the leading end or point end of the needle.

With the foregoing objects, aims and advantages of the invention in view, the preferred embodiment and the manner of use will now be set forth in the following detailed description, the appended claims, and in the several views illustrated in the accompanying drawings.

A brief description of the accompanying drawing is:

Figure 1:
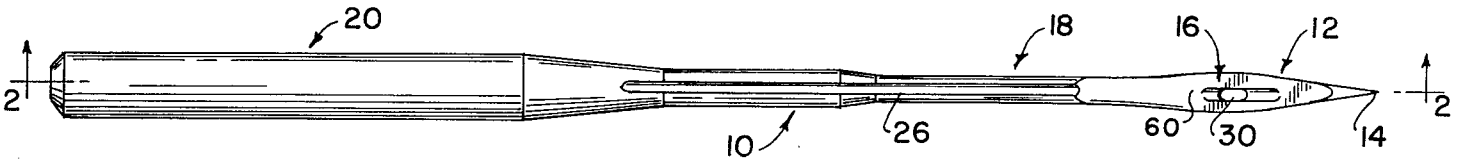
FIG. 1 is an elevation view showing a sewing machine needle.

Referring now to the drawings and more particularly to FIG. 1 where there is shown a needle 10. The needle 10 is constructed of a suitable material, such as steel, and comprises a conical shaped leading end portion 12 which terminates at its leading end in a sharp point 14; an eye portion 16; a blade portion 18; and a butt ended shank portion 20. It should be noted that the embodiment shown in these figures is a needle which has a ball eye. That is, an increased diameter at the eye of the needle which is approximately the equivalent of one needle size.

In the shaping of a needle blank towards the ultimate form of the needle desired, the blank is subjected to a coining or stamping operation to form flat sides along the length of the blade portion. This may be accomplished for example, by coining the blade portion of the blank, between a pair of oppositely disposed flat dies, which exert metal deforming forces towards each other, these forces cause the metal adjacent the die surfaces to flow in a manner such that two oppositely disposed flat side means such as 22 and 24 (FIG. 2) are formed on the sides of the blade portion. At the same time the metal on the top side and bottom side is caused to flow so that the peripheral shape of the blade is changed from a circular shape to a more ovaloid shape.

Figure 2:
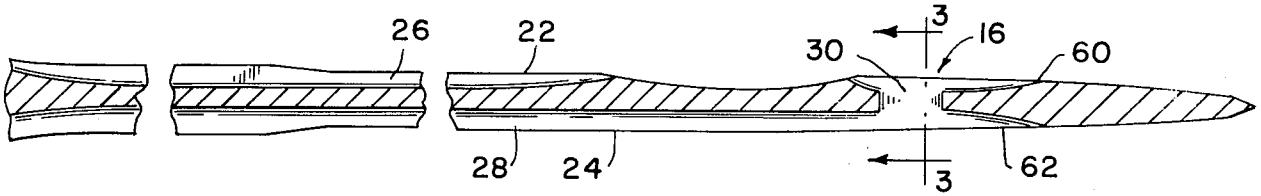
FIG. 2 is a view in cross section respectively taken along lines 2—2 of FIG. 1.
Figure 4:
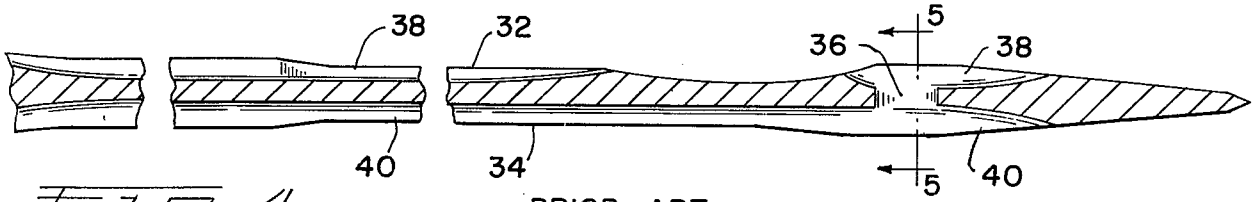
PRIOR ART FIG. 4
FIG. 4 is a partial cross sectional view of a typical prior art needle used on industrial sewing machines.

As may be best seen in FIG. 2, a second coining or stamping operation is performed on the blank thereby forming the top and bottom thread groove means 26 and 28 along the blade portion. The grooves 26 and 28 are centered on the flat sides 22 and 24 as may be best viewed in FIG. 2. During the second coining or stamping operation the needle eye 30 is also created by piercing through the leading or front end of the blade portion thereby forming the needle eye portion 16. Referring now to FIG. 4 where there is shown a standard needle having flat side means 32 and 34 formed in a similar manner to the flat surfaces 22 and 24 in the present embodiment. Two groove means 38 and 40 are formed on the standard needle and serve the purpose of carrying and protecting the thread. As viewed in FIG. 4 the groove 38 and 40 begins at a point slightly forward of the needle eye 36 and extend rearwardly to the shank 20. As is apparent, from a consideration of FIG. 5 the bottoms section means 44 and 46 of the grooves 38 and 40 are generally flat and curve upwardly to form the walls of the groove. As has been previously stated this particular shape is created during the coining or stamping operation. All of the embodiments shown here being idealized versions of the actual production results.

It will be seen from the foregoing description that when needles are constructed according to a stamping or coining procedure there is a substantial amount of material displacement. Particularly the upwardly inclined portion means 48 and 50 of the groove illustrate the point of material displacement. As such, these inclined portions can be distorted or poorly stamped, etc., such that they do not perform the purpose for which they are designed. For example, during the stitch forming process this area, that is the needle eye portion comes in very close proximity to both the looper and the spreader on a Class 39800 overedge sewing machine as previously mentioned. It is well known that the closer these elements can pass to each other, the greater probability of having a good stitch formation will result.

Figure 3:
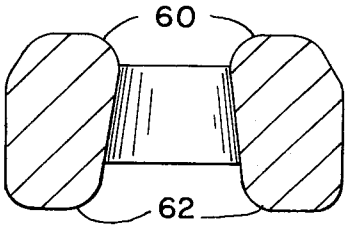
FIG. 3 is a view taken on lines 3—3 of FIG. 2.
Figure 5:
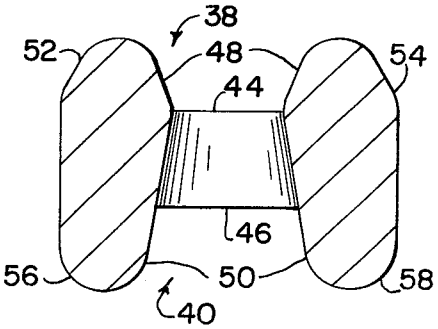
FIG. 5 is a view in cross section respectively taken along lines 5—5 of FIG. 4.

By comparing the preferred embodiment shown in FIGS. 2 and 3 versus the standard needle shown in FIGS. 4 and 5 the advantages of the present invention will now be apparent. The upper portion means 52, 54, 56, and 58 have been physically removed in the preferred embodiment thereby reducing the height of the needle eye area as viewed in FIG. 3. The amount of material which is displaced into these regions during the stamping process is removed to a predetermined extent such that convergent flats 60 and 62 are created upon the needle. The amount of material that is initially displaced during the coining or stamping operation may vary from needle to needle. However, the amount of metal that was initially displaced is removed in a manner which is symmetrical with the longitudinal axis of the needle, therefore the tapered flats 60 and 62 that are produced upon the needle are located with a high degree of uniformity. As has been previously stated, a rather unexpected result develops from these changes. As is well known a ball eye needle will tend to generate less heat than a corresponding standard needle. As is obvious from the description above the removal of the material in the area of the tapers tend to reduce the size of the ball eye in one direction. Therefore, it should be assumed that there would be an increase in the amount of generated heat. However, it has been found in actual tests that the amount of needle heat produced by the preferred embodiment is less than the amount of needle heat produced with a standard ball eye needle. Applicants are unsure as to why this should occur.

The manner in which the two flat surfaces 60 and 62 are placed upon the needle 10 will now be described. First, a hypothetical line perpendicular to the center line of the needle is drawn along line 3—3 as shown in FIG. 2. In order to insure complete uniformity of the flat surfaces 60 and 62 on the needle 10 two equal and specific distances are extended outwardly from the centerline in opposite directions along the imaginary line described above. Through the point where the specific distances cross the hypothetical line, a pair of converging lines are drawn tapering downwards toward the needle point. It should also be understood that the tapered flat can form an angle of from 6 degrees ± 4 degrees and still function in a satisfactory manner. These tapered lines form in a preferred embodiment an acute angle of approximately 4 degrees, or two complimentary angles each forming an acute angle of 2 degrees with the centerline of the needle. Thus, once such measurements have been performed on standard type or class of needles it thereafter becomes a relatively simple matter to produce all other needles of the same type to meet these dimensional requirements. It should be pointed out that these dimensional requirements do not depend upon the exterior or structural features of the needle, keeping in mind that the centerline of the needle is the base line from which all other dimensions are laid off thereby allowing for greater unity in the process of forming the needles.

By utilizing the centerline of the needle as the basis for forming the flat surfaces the remaining displaced metal, that is, the metal forming the ball eye, is symmetrical about the major axis of the needle thereby greatly lessening the chances of imbalance of the needle. By lessening the imbalance of the needle, the vibrating or fluttering associated with imbalanced needles is reduced resulting in less needle breakage and less down time of the machine.

The operation of machining the flats upon the needle, that is, the removal of upper portions 52, 54, 56, and 58 formed during the second stamping operation, provides for a top edge which is generally smooth thereby eliminating fabric cutting and lessening the chances of operator injuries.

The provision of the flats on the needle allows also for less needle breakage when large diameter needles are utilized. As heretofore stated, the looper and the spreader are positioned to pass in a very close relationship with the needle eye during the operation of the machine. With larger diameter needles the clearance between the needle eye and the looper or spreader is reduced because of the added metal on the needle, therefore any deviation in the needle path may cause needle breakage. Therefore, the provision of the flats, that is the removal of the metal in the needle eye area, allows for better clearance between the needle and the looper or spreader thereby providing an added amount of clearance allowing for deviation in the needle path without breakage of the needle. It also follows that on normal size needles the flats allow for a closer relationship of the needle and the looper or spreader, in particularly the needle eye area thereby lessening the chances of skipped stitches.

It is apparent that there has been provided, in accordance with the invention, a needle that fully satisfies the objects, aims, and advantages set forth above. While the invention has been described in conjunction with specific embodiments thereof, it is evident that alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A sewing machine needle comprising:

a cone shaped leading end means terminating in a sharp point means;

a shank means at the butt means of said needle;

a blade means intermediate said cone shaped leading end means and said shank means;

eye means located at the leading end of said blade means;

thread groove means on each side of said needle extending from the rearward end of said cone shaped leading end means to a point closely adjacent said shank means in a plane parallel to the major axis of said needle; and elongated flat means extending on the same side of said needle as said thread groove means, said elongated flats extending from the rearward side of said eye means and symmetrically converging towards said point means forming an acute angle to said major axis and terminating between the forward end of said eye means and said sharp point means.

2. The sewing machine needle of claim 1 wherein:

said acute angle is symmetrical about said major axis at an angle of $6 \pm 4$ degrees.

3. A needle means for use in a sewing machine comprising:

a shank means portion;

a blade means portion;

a ball eye portion;

a flat side means on each side of said blade means portion;

thread groove means extending along said flat side means rearwardly extending from a place adjacent said ball eye portion to the leading end of said shank means portion, and tapered flat means on the same side of said flat side means as said groove means, said tapered flat means cut in said ball eye means portion whereby gradually reducing the depth of said groove means in said ball eye portion.

* * * * *